US005257515A

United States Patent [19]

Ikeguchi

[11] Patent Number: 5,257,515

[45] Date of Patent: Nov. 2, 1993

[54] STRINGER FOR A CONCEALED TYPE OF SLIDE FASTENER

[75] Inventor: Yoshito Ikeguchi, Kurobe, Japan

[73] Assignee: Yoshida Kogyo K. K., Tokyo, Japan

[21] Appl. No.: 951,848

[22] Filed: Sep. 28, 1992

[30] Foreign Application Priority Data

Sep. 30, 1991 [JP] Japan ..... 3-278718

[51] Int. Cl.[5] ..... D04B 11/12; A44B 19/34

[52] U.S. Cl. ..... 66/192; 66/202; 24/393

[58] Field of Search ..... 66/193, 195, 202; 24/393, 392

[56] References Cited

U.S. PATENT DOCUMENTS

| | | | |
|---|---|---|---|
| 3,714,683 | 2/1973 | Fröhlich et al. | 66/195 X |
| 3,757,541 | 9/1973 | Fröhlich et al. | 66/202 X |
| 3,762,002 | 10/1973 | Fröhlich et al. | 66/195 X |
| 3,974,550 | 8/1976 | Fujisaki et al. . | |
| 4,002,045 | 1/1977 | Fröhlich | 66/202 |
| 4,015,450 | 4/1977 | Matsuda et al. | 66/195 |
| 4,074,398 | 2/1978 | Matsuda et al. | 66/195 X |
| 4,265,003 | 5/1981 | Matsuda | 66/193 X |
| 4,378,683 | 4/1983 | Matsuda et al. | 66/202 X |
| 4,409,802 | 10/1983 | Matsuda | 66/195 X |
| 4,498,316 | 2/1985 | Matsuda | 66/193 X |

FOREIGN PATENT DOCUMENTS

| | | |
|---|---|---|
| 2200444 | 7/1973 | Fed. Rep. of Germany . |
| 2236223 | 4/1976 | France . |
| 2496134 | 6/1982 | France . |
| 55-37241 | 9/1980 | Japan . |
| 1498280 | 1/1978 | United Kingdom . |

*Primary Examiner*—Clifford D. Crowder
*Assistant Examiner*—John J. Calvert
*Attorney, Agent, or Firm*—Hill, Steadman & Simpson

[57] ABSTRACT

A stringer for a concealed type of slide fastener has a warp-knit tape comprising a web portion and a longitudinal edge portion for mounting thereon a row of interlocking fastener elements. The edge portion is comprised of yarns of lower denier disposed in between adjacent wales such that the edge portion presents a cross-sectionally relatively low profile contrastive to the web portion thereby clearly defining a location for folding the tape on itself to conceal the fastener elements from external view.

7 Claims, 6 Drawing Sheets 0-1/1-0

1-2/1-0

0-0/4-4

0-1/1-0

2-0/0-2

0-0/4-4

STRINGER FOR A CONCEALED TYPE OF SLIDE FASTENER

BACKGROUND OF THE INVENTION

1. Field of the Invention

This invention relates to slide fasteners of a concealed design and more particularly to a stringer of a warp-knit structure therefor.

2. Prior Art

Slide fasteners are well known which comprise a pair of rows of interlocking fastener elements formed from a continuous filament or wire and secured to respective folded edges of opposed stringer tapes, and such fasteners when closed by the slider conceal the elements from external view, only leaving a linear seam in the junction of the opposed tapes.

A prior art example of a warp-knit support tape for concealed-type slide fastener is disclosed in Japanese Laid-Open Utility Model Publication No. 51-44405, in which a particular wale adjacent to the path of a sewing needle is formed with fewer knit threads than the remaining portions of the type, more specifically with chain-forming threads omitted at that wale so as to reduce the height of this wale. This arrangement is intended to facilitate penetration of a sewing needle through an interwale groove between two adjacent wales, one higher or thicker than the other, bordering between a tape edge portion and a main web portion. However, due to these adjacent wales being different in knit structure and hence in elongation degree, the support tape when sewn is liable to pucker or other wise appear unsightly.

Another known warp-knit tape for use as a support for a concealed or masked type slide fastener is disclosed in Japanese Utility model Publication No. 54-35769 in which there is provided a particular thickened wale located at one tape edge and defined between adjacent interwale grooves which are wider than those in the remaining portions of the tape which are uniformly knitted. Such tape edge formation can be conveniently utilized for sewing a row of fastener elements thereon. However, since the tape web other than the tape edges is of a uniform knit structure, it is difficult to fold the tape on itself at the proper position for mounting the fastener elements, or to accurately define a location for sewing the tape onto a garment.

A further prior art warp-knit tape for slide fastener is described in Japanese Laid-Open Patent Publication No. 55-37241 in which the knit tape is comprised of chain stitches and open-lap stitches both of non-textured yarns combined to form longitudinally extending wales and laid-in weft threads formed with two different textured yarns. This tape is knitted uniformly throughout its width and suitable for use as a support tape for ordinary slide fasteners but lacks design considerations required for use as one for a concealed type of slide fastener.

SUMMARY OF THE INVENTION

With the foregoing difficulties of the prior art in view, the present invention seeks to provide a warp-knit stringer tape for a concealed slide fastener which can be folded at a predetermined proper position to form a folded region fit for mounting a row of fastener coupling elements and which is clearly discernible as to where it is to be sewn properly into position on a garment or the like.

According to the invention, there is provided a stringer for a concealed type of slide fastener which comprises a warp-knit tape and a row of interlocking fastener elements mounted thereon, the tape having a web portion and a longitudinal edge portion, the web portion being formed by chain stitches of non-textured yarn and defining parallel longitudinal wales alternating with interwale grooves, tricot stitches of textured yarn disposed between adjacent wales and weft threads of textured yarn extending over the wales, the longitudinal edge portion being formed by chain stitches, and the edge portion and the web portion defining therebetween an interwale groove comprised of a mix of textured and non-textured yarns.

DETAILED DESCRIPTION OF THE INVENTION

Figure 5:
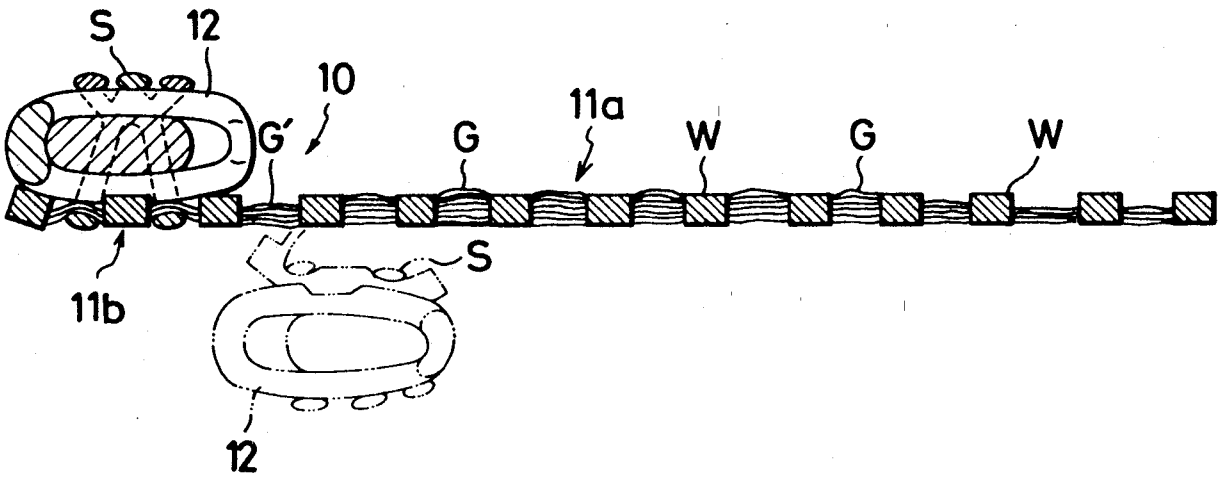
FIG. 5 is a transverse cross-sectional view of a stringer tape having a row of coupling elements mounted on one of its longitudinal edges.
Figure 6:
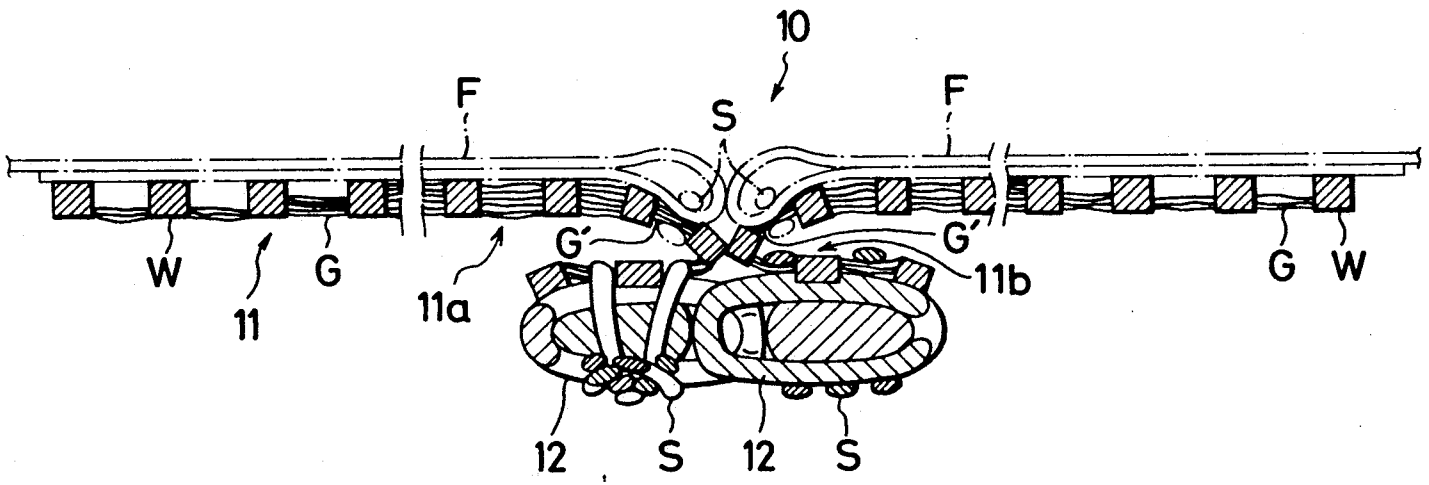
FIG. 6 is a transverse cross-sectional view of a pair of stringer tapes with respective confronting rows of coupling elements shown coupled together.

Referring now to the drawing and FIG. 5 in particular, there is shown one of a pair of fastener stringers generally designated 10 which comprises a warp-knit stringer tape 11 and a row of interlocking fastener elements 12 mounted on one longitudinal edge of the tape 11. A pair of these fastener stringers are shown in FIG. 6 as being coupled together in a manner well known in the art of a so-called concealed type of slide fastener.

Figure 1:
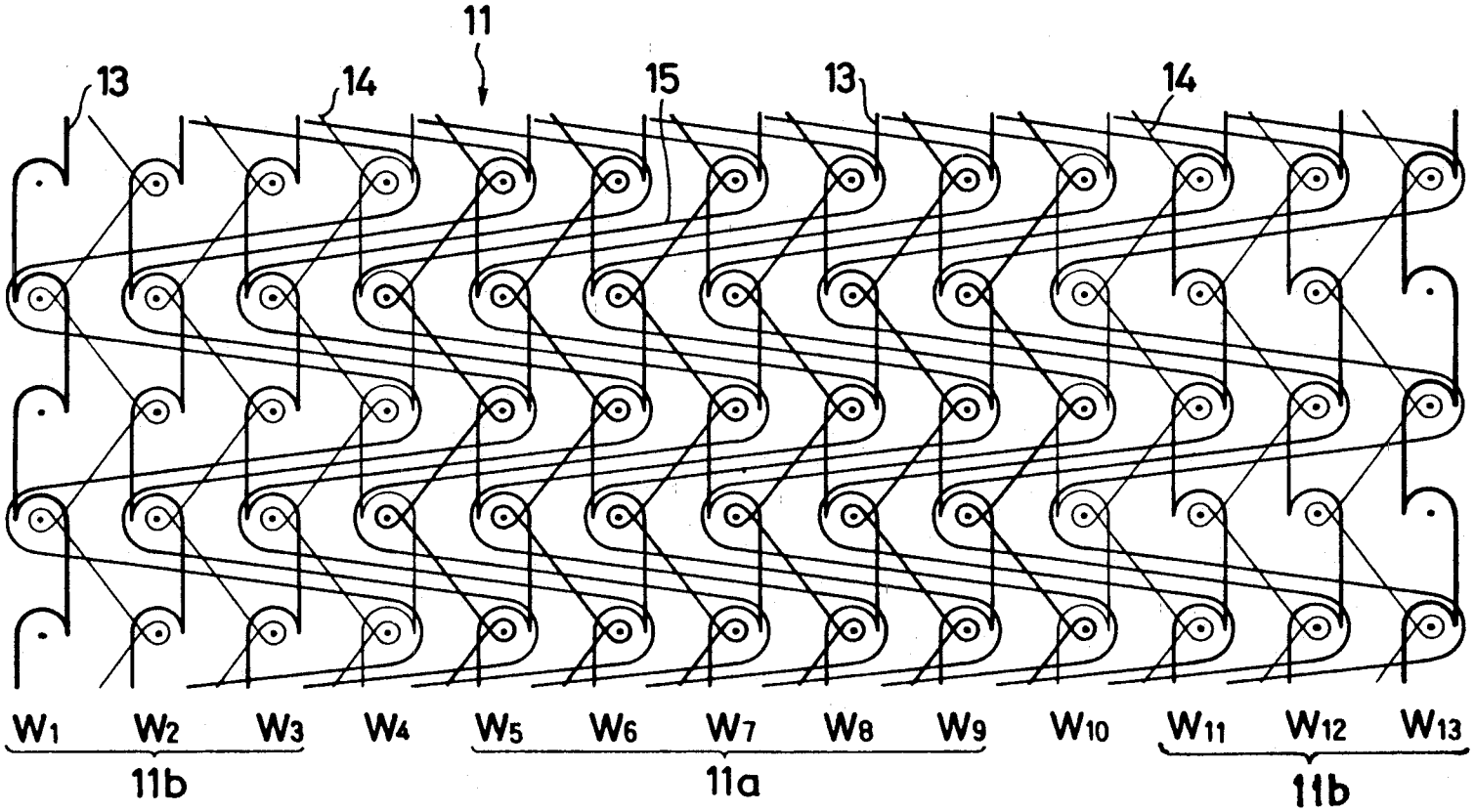
FIG. 1 is a diagram schematically illustrating the knit patterns by which a plurality of sets of yarns are knit in a stringer tape for a concealed slide fastener embodying the invention.
Figure 2A:
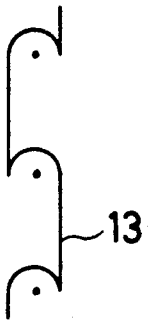
FIGS. 2(A), 2(B) and 2(C) are diagrams showing the guide bar movement for each of the respective sets of knit yarns shown in FIG. 1.
Figure 2B:
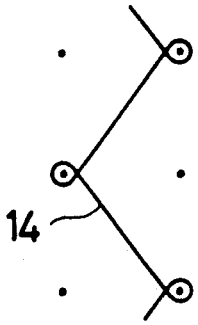
Figure 2C:
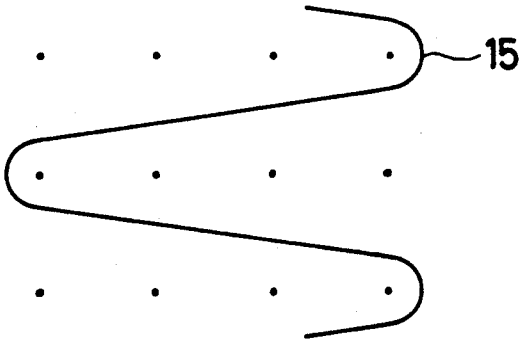

As better shown in FIG. 1, each of the stringer tapes 11 consists of a warp-knit structure which has a web portion 11*a* occupying a majority of the tape fabric and two symmetric opposed longitudinal edge portions 11*b*, 11*b*, either one of which is utilized for mounting thereon a row of interlocking elements 12.

According to one embodiment of the invention, the web portion 11*a* is formed by chain stitches 13 of non-textured yarn knitted in the pattern 0-1/1-0 and defining a plurality of parallel longitudinal wales W (a total of thirteen wales $W_1$–$W_{13}$ as illustrated), tricot stitches 14 of textured yarn knitted in the pattern 1-2/1-0 and disposed between two adjacent wales and weft threads 15 of textured yarn laid in the pattern 0-0/4-4 and extending over and connecting every four wales W. The chain stitches 13, tricot stitches 14 and laid-in weft threads 15 in the web portion 11*a* are all formed with yarns of a median size, e.g. 100 deniers.

Each of the oppositely disposed longitudinal edge portions 11*b*, 11*b* of the knit tape 11 extending over three outermost wales $W_1$, $W_2$ and $W_3$ (or $W_{11}$, $W_{12}$ and $W_{13}$) is comprised of chain stitches 13, tricot stitches 14, and laid-in weft threads 15, all of which are formed by non-textured yarns. Thus, there exists a mix of textured and non-textured yarns in an interwale groove G' between the third and fourth outermost wales $W_3$ and $W_4$, through which groove G' is passed a sewing needle (not shown) to attach the stringers 10 with sewn seams S to a garment fabric F as illustrated in FIG. 6. The presence of such mixed yarns in the interwale groove G' provides moderate rigidity to facilitate folding or bending therealong the tape 11 carrying the fastener elements on its edge portion 11*b* and further to allow the sewing needle to penetrate flexibly therethrough. However, the first outermost wale $W_1$ ($W_{13}$) is formed by chain stitches 13 of a large size yarn, e.g. 150 deniers to maintain its thickness substantially equal to the rest of wales W in the tape 11. The second and third outermost wales $W_2$ and $W_3$ ($W_{11}$ and $W_{12}$) are formed of chain stitches of a median size yarn, e.g. 100 deniers. The fourth wale $W_4$ ($W_{10}$) defining a border line between the web portion 11*a* and the edge portion 11*b* is formed with chain stitches of a small size yarn, so as to maintain its dimension substantially equal to the neighboring wale $W_3$ thereby ensuring freedom from irregular longitudinal stretch and further from transverse displacement which would otherwise occur with knit yarns omitted as in the case of the aforementioned prior art. The tricot stitches 14 in the edge portion 11*b* of the knit tape 11 are also formed of a small size yarn of 70 deniers.

The stringer tape 11 of the above knit construction presents a relatively low profile at the edge portion 11*b* and a relatively high profile at the web portion 11*a* as cross-sectionally observed as shown in FIGS. 5 and 6. This contrastive structural feature serves to dictate one without fail to fold the tape 11 precisely about the third outermost wale $W_3$ in the edge portion 11*b* and sew the fastener elements 12 at and along interwale grooves G between the wales $W_1$, $W_2$ and $W_3$ as shown in FIGS. 5 and 6.

Figure 3:
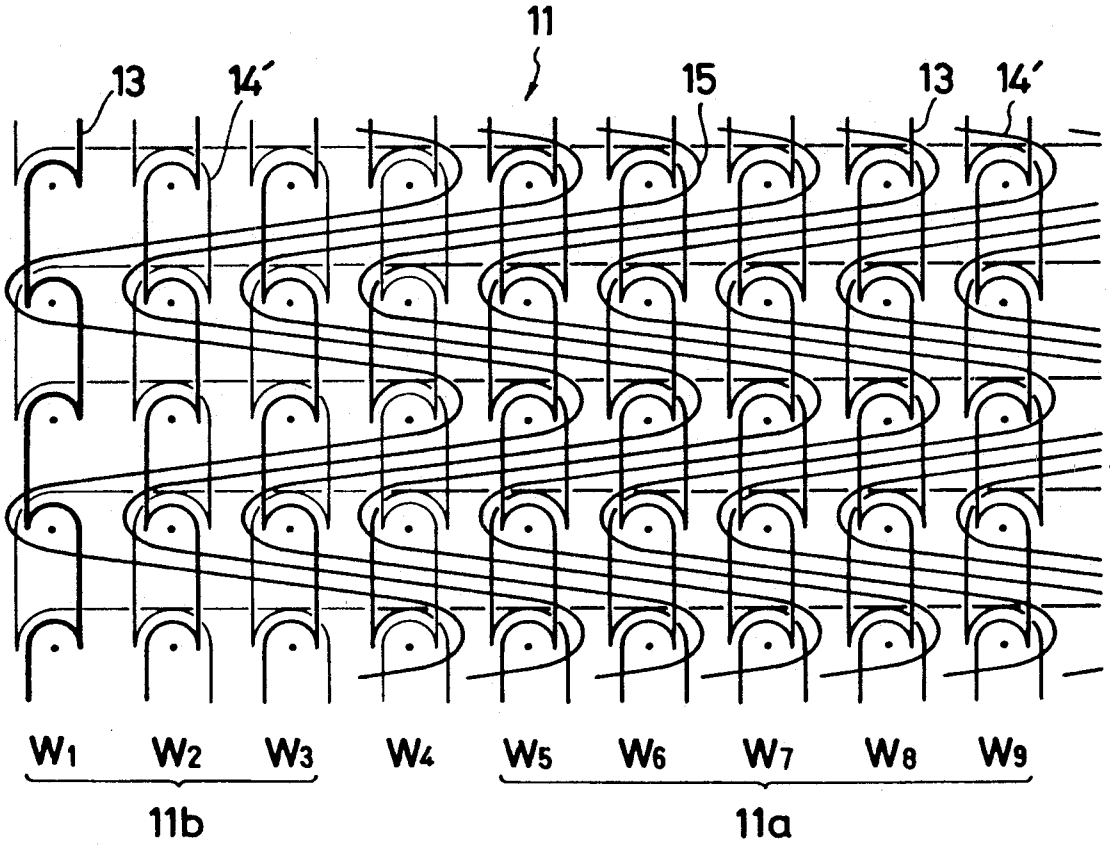
FIG. 3 is a view similar to FIG. 1 but showing a modified arrangement of knit yarns according to the invention.
Figure 4A:
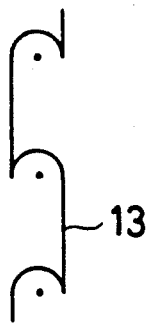
FIGS. 4(A), 4(B) and 4(C) are diagrams showing the guide bar movement for each of the knit patterns shown in FIG. 3.
Figure 4B:
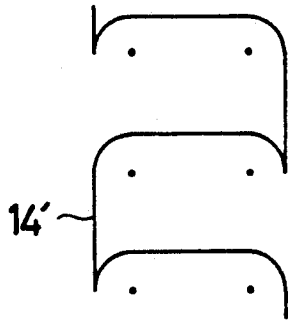
Figure 4C:
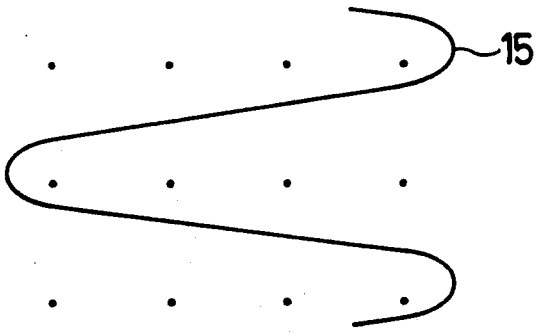

Referring to FIGS. 3 and 4, there is shown a modified warp knit structure embodying the invention which is basically the same as but differs from a warp knit tape in that an open-lap stitch 14' of the pattern 2-0.0-2 is used in place of the tricot stitch 14. The open-lap stitches 14' disposed in the web portion 11*a* of the tape 11 are formed with a median size yarn of 100 deniers and those in the edge portion 11*b* are formed with a small size yarn of 70 deniers.

Many other changes and modification in the embodiments above described may be made without departing from the scope of the appended claims.

As for an example, the laid-in weft thread 15 may be substituted by a single cord stitch.

What is claimed is:

1. A stringer for a concealed type of slide fastener which comprises a warp-knit tape and a row of interlocking fastener elements mounted thereon, said tape having a web portion and a longitudinal edge portion, said web portion being formed by chain stitches of non-textured yarn and defining parallel longitudinal wales alternating with interwale grooves, tricot stitches of textured yarn disposed between adjacent wales and weft threads of textured yarn extending over said wales, said longitudinal edge portion also being formed by said weft threads, chain stitches, and tricot stitches, all of which are formed of non-textured yarn, said edge portion and said web portion defining therebetween an interwale groove comprised of a mix of textured and non-textured yarns and a wale formed with chain stitches of a lower denier yarn, than those of said edge portion, to maintain its dimension substantially equal to the neighboring wale of said edge portion, and wherein said edge portion of said tape comprises a first outermost wale formed with a large size yarn and second and third outermost wales with a median size yarn and said tricot stitches in said edge portion are formed with a small size yarn.

2. A stringer according to claim 1 wherein said tape includes an open-lap stitch in place of said tricot stitch.

3. A stringer according to claim 1 wherein said tricot stitches in said edge portion are formed with yarns of a denier such that said edge portion presents a cross-sectionally relatively low profile contrastive to said web portion.

4. A stringer according to claim 1 wherein said chain stitches are knitted in the pattern 0-1/1-0.

5. A stringer according to claim 1 wherein said tricot stitches are knitted in the pattern 1-2/1-0.

6. A stringer according to claim 1 wherein said weft threads are knitted in the pattern 0-0/4-4.

7. A stringer according to claim 2 wherein said open-lap stitch is knitted in the pattern 2-0/0-2.

* * * * *